US005378168A

United States Patent [19]

Sumida

[11] Patent Number: 5,378,168

[45] Date of Patent: Jan. 3, 1995

[54] CONNECTOR

[75] Inventor: Tatsuya Sumida, Yokkaichi, Japan

[73] Assignee: Sumitomo Wiring Systems, Mie, Japan

[21] Appl. No.: 114,305

[22] Filed: Sep. 2, 1993

[30] Foreign Application Priority Data

Oct. 6, 1992 [JP] Japan ..... 4-075882[U]

[51] Int. Cl.[6] ..... H01R 13/627

[52] U.S. Cl. ..... 439/358; 439/357

[58] Field of Search ..... 439/350, 351, 352, 353, 439/354, 355–358

[56] References Cited

U.S. PATENT DOCUMENTS

| | | | |
|---|---|---|---|
| 3,950,067 | 4/1976 | Leavesley | 439/358 |
| 4,272,145 | 6/1981 | LaDuke | 439/358 |
| 4,431,244 | 2/1984 | Anhalt et al. | 439/358 |
| 4,564,252 | 1/1986 | Kato et al. | 439/358 |
| 4,634,204 | 1/1987 | Detter et al. | 439/352 |
| 4,867,699 | 9/1989 | Oda et al. | 439/355 |
| 4,915,643 | 4/1990 | Samejima et al. | 439/357 |
| 4,923,409 | 5/1990 | Ishii | 439/358 |
| 5,104,253 | 4/1992 | Zielinski et al. | 439/357 |

*Primary Examiner*—Gary F. Paumen
*Assistant Examiner*—Hien D. Vu
*Attorney, Agent, or Firm*—Oliff & Berridge

[57] ABSTRACT

A lock arm is integrally formed on an outer surface of a connector housing of an insertable connector through a support leg and is engaged with a lock projection on a relay connector portion. A pair of protective walls are provided respectively on opposite sides of the lock arm and are spaced from the lock arm. The protective walls are disposed at a region corresponding to a gap between the lock arm and the connector housing. The front end portions of these protective walls are interconnected by a bridge portion. With this arrangement, a wire is prevented from being caught in the gap between the lock arm and the connector housing.

12 Claims, 3 Drawing Sheets

CONNECTOR

BACKGROUND OF THE INVENTION

This invention relates to a connector of the type in which one connector housing is inserted into a hood portion of another connector housing to be connected thereto.

For example, for connecting a terminal of a relay, mounted in an engine room of a vehicle, to a relay circuit, it is a common practice to use a connector. A specific example of such construction as shown in FIG. 5 is known.

In FIG. 5, for example, four male terminals (not shown) electrically connected respectively to relay contacts are formed on and projected from a bottom surface portion of a relay 1, and a tubular hood portion 2 of a cross-shaped cross-section covering these male terminals is provided. These male terminals and the hood portion 2 function as one connector.

In addition to the relay-containing connector, there is provided a tubular connector housing 3 of a cross-shaped cross-section, and female terminals (not shown) are mounted within this connector housing in which a retainer is attached. The connector housing 3 is of such a shape and size that it can be inserted into the hood portion 2 of the relay 1. This connector housing is inserted deep into the hood portion 2, so that the female terminals of this connector housing are connected to the male terminals of the relay 1, respectively.

A lock arm 5 is integrally molded or formed on the outer surface of the insertable connector housing 3 through a support leg 5*a*, and an engagement hole 5*b* is formed in a front portion of the lock arm 5. On the other hand, an engagement projection 6 for engagement with the engagement hole 5*b* is formed on the outer surface of the hood portion 2 of the relay 1.

In this construction, when the connector housing 3 is held by the hand, and is inserted into the hood portion 2 of the relay 1, the front end of the lock arm 5 abuts against the engagement projection 6, so that the front end portion of this lock arm is elastically deformed or raised. Then, when the engagement projection 6 is engaged in the engagement hole 5*b*, the connector housing 3 is prevented from being withdrawn.

A wire harness having a connector of this type connected thereto is pretty roughly handled during transport and an assembling step. In the above-mentioned conventional connector, since the lock arm 5 is exposed on the outer surface of the connector housing 3, there are occasions when a wire W is received in a gap g between the lock arm 5 and the connector housing 3, as indicated in phantom in FIG. 5. In this condition, if a high tension is applied to the wire W, the lock arm 5 may be pulled strongly to be deformed, so that the lock function by the lock arm 5 is damaged. Furthermore, even if the wire W is not caught, a strong force may act on the lock arm 5, for example, during transport of the wire harness, so that the lock arm 5 is broken or deformed, which results in a failure of the lock function.

To deal with these problems, it is proposed to provide a cover for covering the gap g between the lock arm 5 and the connector housing 3. However, if such a cover is provided on the connector housing 3 which has the lock arm 5 formed on the outer surface thereof, and is to be inserted into the hood portion 2 of its mating connector as shown in FIG. 5, this cover would prevent the insertion of the connector housing, so that the connection of the connector becomes difficult. Therefore, it has been desired to provide the type of construction which can prevent deformation and damage of the lock arm 5 without preventing the connection of the connector.

SUMMARY OF THE INVENTION

The present invention has been made in view of the above problems, and an object of the invention is to provide a connector of the type in which a lock arm is formed on a connector housing to be inserted into a hood portion, and the deformation and damage of the lock arm is prevented without preventing the insertion of the connector housing.

A connector according to the present invention is characterized in that protective walls are provided on an insertable connector housing, and are disposed respectively on opposite sides of a lock arm, the protective arms being disposed at a region corresponding to a gap between the lock arm and the outer surface of the insertable connector housing; and an entrance-allowing gap which a hood portion of a receiving connector housing enters is formed between each of the protective walls and the insertable connector housing.

Since the protective walls are provided at the region corresponding to the gap between the lock arm and the outer surface of the connector housing, the protective walls positively prevent a foreign matter, such as a wire, from entering this gap. And besides, the entrance-allowing gap which the hood portion of the receiving connector housing enters is provided between each of the protective walls and the insertable connector housing, the hood portion is allowed to enter, and the connection of the connector is not affected.

As described above, in the connector of the present invention, little difficulty is encountered with the connection of the connectors, and there is achieved an excellent advantage that deformation and damage of the lock arm are positively prevented.

DETAILED DESCRIPTION OF PREFERRED EMBODIMENTS

Figure 1:
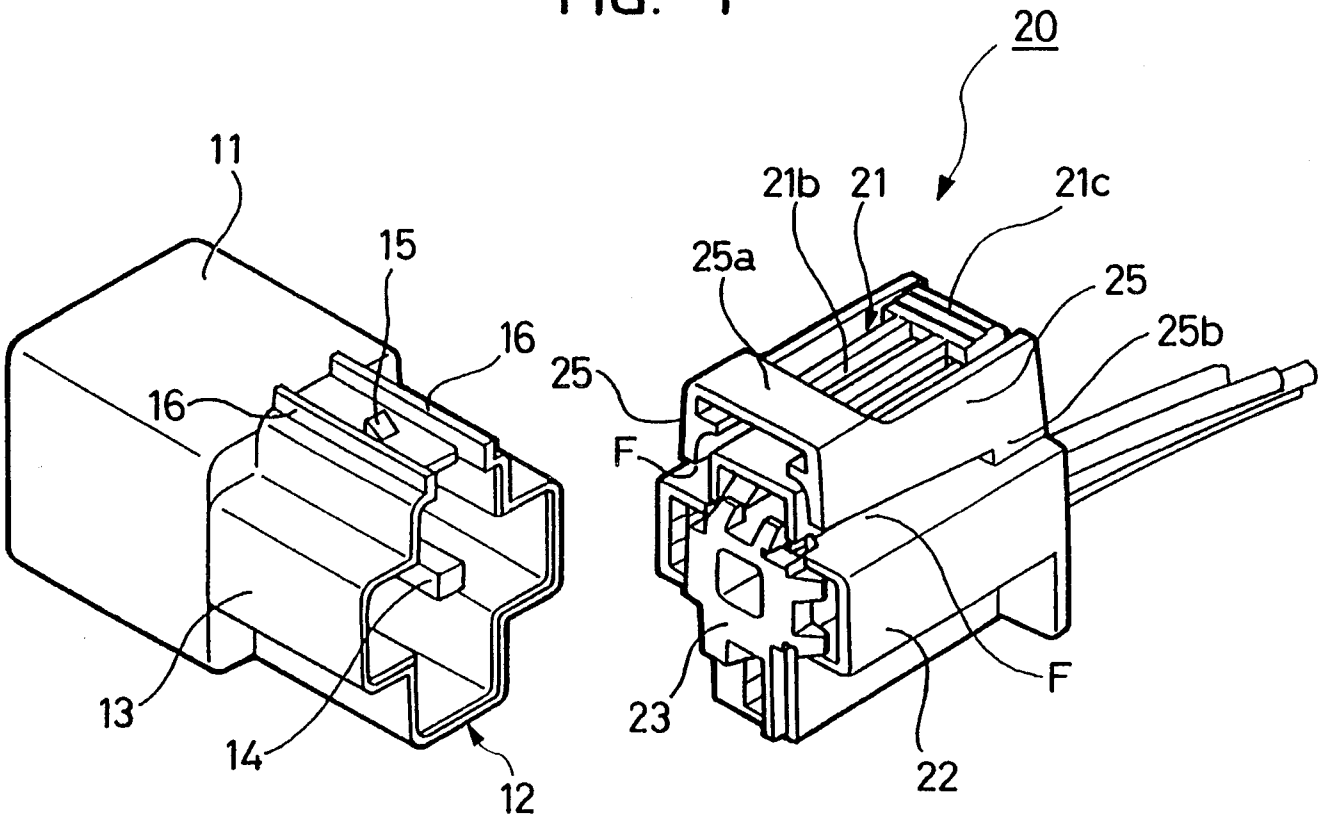
FIG. 1 is a perspective view showing an overall construction of a preferred embodiment of the present invention.
Figure 2:
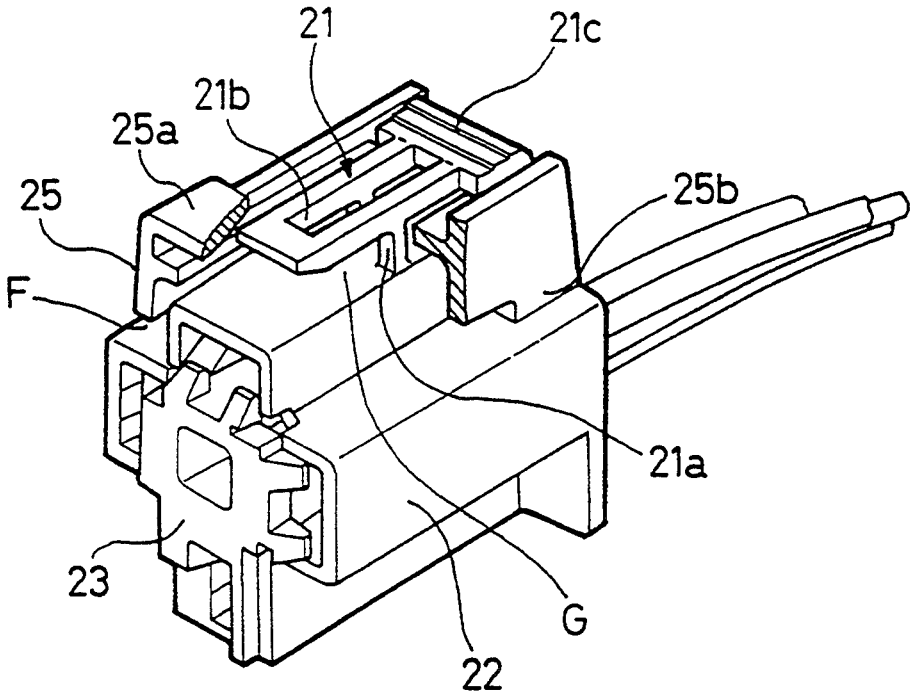
FIG. 2 is a partly-broken, perspective view of a connector housing on an enlarged scale.

One preferred embodiment in which the present invention is applied to a connector of a relay for a vehicle will now be described with reference to FIGS. 1 and 2.

A relay body 11 has a generally rectangular parallelepipedic shape as a whole, and a connector portion 12 is formed integrally on a bottom face of the relay body. The connector portion 12 includes, for example, four male terminals (not shown) electrically connected to relay contacts (not shown) provided within the relay body 11 and a tubular hood portion 13 of a cross-shaped cross-section that covers these male terminals. A projection 14 for preventing an improper connection is formed within the hood portion 13 at a generally central portion thereof. Provided on an upper portion (in the drawings) of a peripheral surface of the hood portion 13 is a lock projection (lock portion) 15 that engages a lock arm 21 formed on an insertable connector 20 (later described). As shown in FIG. 1, the face of the peripheral wall of the hood portion 13 on which the lock projection 15 is formed is slightly shorter than the other faces of the hood portion 13. A pair of opposed guide walls 16 are integrally formed on that face in such a manner that the lock projection 15 is disposed between these guide walls.

The insertable connector portion 20 for connection to the above relay connector 12 also includes a tubular connector housing 22 of a cross-shaped cross-section. Female terminals (not shown) are provided within the connector housing 22. When a retainer 23 is inserted into and attached to the connector housing 22 from the front side of this connector housing, it can be determined that the female terminals are in a completely-installed condition. The connector housing 22 is of such a shape and size that it can be inserted into the hood portion 13 of the relay connector portion 12. When the connector housing 22 is inserted deep into the hood portion 13, the female terminals are connected respectively to the male terminals of the relay connector.

The lock arm 21 is molded or formed integrally on the outer surface of the connector housing 22 of the insertable connector 20 through a support leg 21*a*. The lock arm 21 extends in a direction of insertion of the connector housing 22, and a gap G is formed between the lock arm 21 and the outer surface of the connector housing 22. The lock arm 21 has an engagement hole 21*b* in its front portion and a press portion 21*c* at its rear end portion. By pressing the press portion 21*c*, the lock arm 21 is elastically deformed about the support leg 21*a*, so that its front end is lifted.

A pair of protective walls 25 are formed respectively on opposite (right and left) sides of the lock arm 21 and are spaced a distance F from the lock arm. The protective walls 25 are disposed at a region corresponding to the gap G between the lock arm 21 and the connector housing 22 and are interconnected at their front ends by a bridge portion 25*a*. With this arrangement, the front end portion of the lock arm 21 is covered in a channel-shaped configuration, that is, from the opposite sides and the upper side, with the gaps F provided therebetween. Thus, the protective walls 25 surround the lock arm 21, and the entrance-allowing gaps F are provided between the walls 25 and the lock arm 21. The hood portion 13 can enter the entrance-allowing gaps F. Each of the right and left protective walls 25 is integrally connected to the connector housing 22 through a connection portion 25*b* provided at the rear end portion of the protective wall. The entrance-allowing gap F for the hood portion 13 is continuous with a space between the connector housing 22 and the protective wall 25 except for its connection portion 25*b*.

Figure 3:
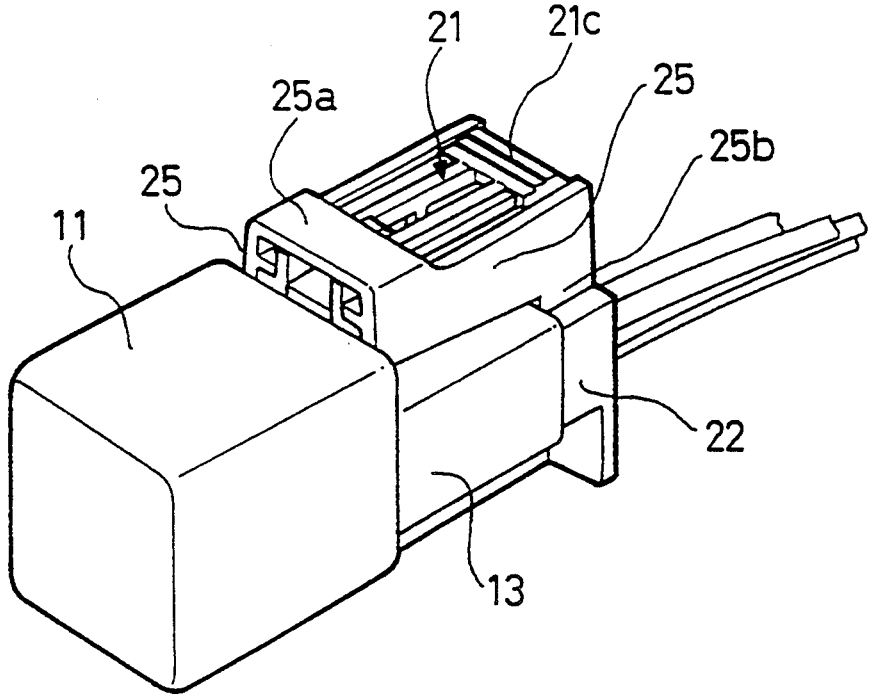
FIG. 3 is a perspective view showing the connector in its connected condition.

In the above construction, for connecting the connectors together, the connector housing 22 of the insertable connector 20 is held and inserted into the hood portion 13 of the relay connector portion 12. As a result, the connector housing 22 enters the entrance-allowing gaps F provided between the connector housing 22 and the protective walls 25, so that the hood portion 13 fits on the connector housing 22. During this operation, the front end of the lock arm 21 abuts against the lock projection 15 of the hood portion 13, so that the front end portion of the lock arm is elastically deformed upwardly. When the lock projection 15 is engaged in the engagement hole 21*b* in the lock arm 21, the terminals of the connector 12 are connected respectively to the terminals of the connector 20, and at the same time, the connector housing 22 is prevented from withdrawal (see FIG. 3).

In the construction of this embodiment, as described above, the front end portion of the lock arm 21 is covered by the protective walls 25 in a channel-shaped configuration, that is, from the opposite sides and the upper side, and therefore, even if a wire harness having the connector 20 attached thereto is handled roughly during transport or an assembling step, an impact force is prevented from acting on the lock arm, and a wire W is positively prevented from being caught in the gap G between the lock arm and the connector housing, preventing deformation and damage of the lock arm 21 and the lock function of the lock arm. The protective walls 25 surround the lock arm 21 in such a manner as to provide the entrance-allowing gaps F for receiving the hood portion 13, and the protective walls 25 are connected to the connector housing 22 through their rear connection portions 25*b*. Therefore, when the connectors are connected together, the hood portion 13 is inserted into the entrance-allowing gaps F. Even though the construction is such that the hood portion 13 is adapted to fit on the connector housing 22 with the lock arm 21, this fitting can be effected positively, and the function of connection between the two connectors is not affected at all.

The present invention is not to be limited to the above embodiment shown in the drawings, and for example, the following modifications are possible.

Figure 4:
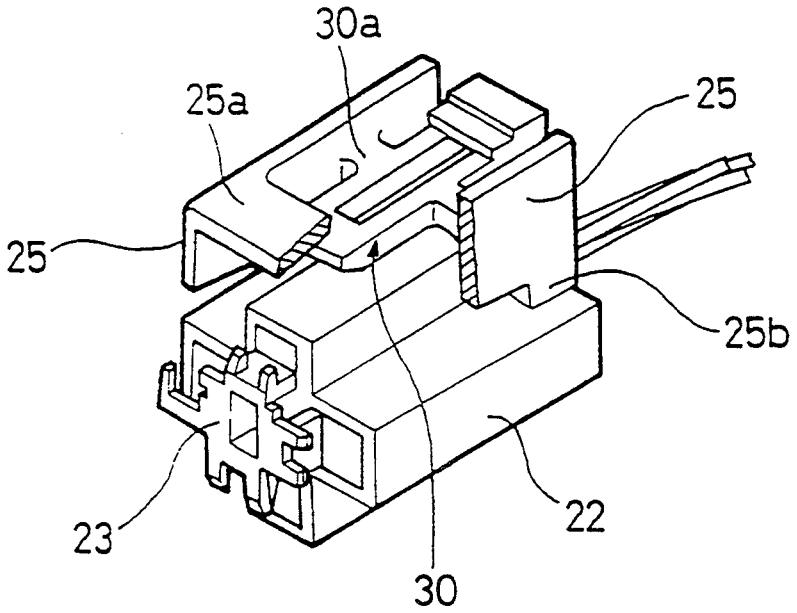
FIG. 4 is an enlarged perspective view of another embodiment of a connector housing of the invention.
Figure 5:
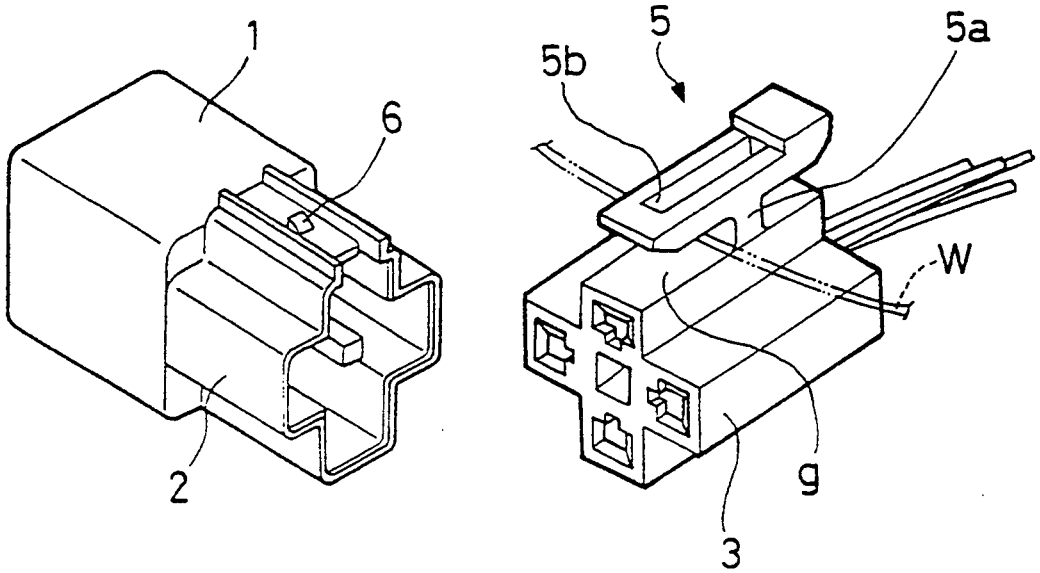
FIG. 5 is a perspective view of the conventional relay connector.

In the above embodiment, although the lock arm 21 is molded integrally on the connector housing 22 through the support arm 21*a*, this is not always necessary. For example, as shown in FIG. 4, a lock arm 30 may be formed on protective walls 25, connected to a connector housing 22, through connection portions 30*a*. Alternatively, the support leg 21*a* and the connection portions 30*a* may be both provided.

Although not shown in the drawings, a lock arm 21 is pivotally mounted on a connector housing 22 through a support leg 21, as described in connection with the above embodiment, and the protective walls 25 are integrally formed on the lock arm 21 through connection portions, as opposed to on the connector housing 22. In this case, the protective walls are spaced from the outer peripheral surface of the connector housing to provide entrance-allowing gaps which a hood portion of a relay connector enters.

In the above embodiments, although the relay connector is used, the invention is not limited to it and can be extensively applied to ordinary connectors connected to wires. Namely, the invention can be extensively applied to those connectors in which one connector housing is inserted into a hood portion of another connector housing, and a lock arm formed on the outer surface of the insertable connecting housing is engaged with a lock portion provided on the other connector housing, thereby holding the two connector housings in a connected condition.

Furthermore, the present invention is not to be restricted to the above embodiments, and various modifications can be made without departing from the scope of the invention.

What is claimed is:

1. A connector comprising:

a first connector housing insertable into a hood portion of a second connector housing, said first connector housing having a lock arm formed on an outer surface thereof and spaced therefrom to form a lock arm gap, said lock arm engageable with a lock portion formed on said second connector housing, thereby holding said connector housings in a connected condition; and protective walls formed on said first connector housing, and disposed respectively on opposite sides of said lock arm and spaced from said outer surface to form an entrance-allowing gap, said protective walls being disposed at a region corresponding to said lock arm gap between said lock arm and the outer surface of said first connector housing, said entrance-allowing gap receiving said hood portion when said first connector housing is inserted into said hood portion of said second connector housing.

2. A connector as claimed in claim 1, wherein said lock arm has an engagement hole in a front portion, and a press portion in a rear end portion for lifting up said front portion.

3. A connector as claimed in claim 2, wherein said hood portion comprises a lock projection engageable with said engagement hole.

4. A connector as claimed in claim 1, wherein said lock arm is attached to at least one support leg connected to said outer surface.

5. A connector as claimed in claim 1, wherein said protective walls comprise a stepped connection portion attached to said outer surface.

6. A connector comprising:

a first connector housing receiving a plurality of first terminals;

a second connector housing receiving a plurality of second terminals and comprising a hood portion, said first connector housing being insertable into said hood portion;

a lock arm fixed to said first connector housing and spaced from an outer surface of said first connector housing to form a lock arm gap; and a protective wall fixed to said first connector housing and disposed to surround said lock arm, said protective wall being spaced from said outer surface to form an entrance-allowing gap, said hood portion comprising a surface that is engageable with said lock arm, said entrance-allowing gap receiving said surface when said first connector housing is inserted into said hood portion.

7. A connector as claimed in claim 6, further comprising a lock projection on said surface, said lock arm comprising an engagement hole engageable with said lock projection.

8. A connector as claimed in claim 6, wherein said lock arm is attached to at least one support leg connected to said outer surface.

9. A connector as claimed in claim 6, wherein said protective wall comprises a stepped connection portion attached to said outer surface.

10. A connector comprising:

a first connector housing;

a second connector housing engageable with said first connector housing; and a lock arm unit comprising a lock arm disposed within a protective wall, said protective wall including a stepped portion attached to an outer surface of one of said first and second connector housings such that an entrance-allowing gap is formed between said protective wall and said outer surface, said entrance-allowing gap facilitating engagement between said first and second connector housings.

11. A connector housing as claimed in claim 10, wherein said lock arm is attached to said protective wall by a connection portion.

12. A connector housing as claimed in claim 11, wherein said lock arm is attached to at least one support leg connected to said outer surface.

* * * * *